166-66 Sub in 166/66.4 2/15/88 SR
7/1/86 XR 4,597,440

United States Patent [19]

Pottier

[11] Patent Number: 4,597,440

[45] Date of Patent: Jul. 1, 1986

[54] METHOD AND APPARATUS FOR DISPLACING LOGGING TOOLS IN DEVIATED WELLS

[75] Inventor: Alain P. Pottier, Houston, Tex.

[73] Assignee: Schlumberger Technology Corporation, Houston, Tex.

[21] Appl. No.: 719,668

[22] Filed: Apr. 4, 1985

[51] Int. Cl.[4] ..... E21B 47/12; E21B 23/00

[52] U.S. Cl. ..... 166/250; 166/50; 166/66; 166/381

[58] Field of Search ..... 166/250, 255, 380, 381, 166/383, 50, 65 R, 66, 117.5, 117.6; 73/152

[56] References Cited

U.S. PATENT DOCUMENTS

| | | | |
|---|---|---|---|
| 2,726,848 | 12/1955 | Montgomery et al. | 175/40 |
| 3,437,169 | 4/1969 | Youmans | 73/152 |
| 3,675,478 | 7/1972 | Nystrom | 73/152 |
| 4,064,939 | 12/1977 | Marquis | 166/253 |
| 4,349,072 | 9/1982 | Escaron et al. | 166/250 |
| 4,457,370 | 7/1984 | Wittrisch | 166/250 |
| 4,485,870 | 12/1984 | Walulik | 166/250 |

FOREIGN PATENT DOCUMENTS 2006398 5/1979 United Kingdom .

OTHER PUBLICATIONS

"Techniques of Drilling and Producing High Drift Angle Directional Wells" by Johnston et al., Fourth World Petroleum Congress Proceedings, 1955.

*Primary Examiner*—Stephen J. Novosad
*Assistant Examiner*—Hoang C. Dang

[57] ABSTRACT

Method for displacing a logging tool through a non-gravity descent portion of a well such as a highly deviated portion, comprising the steps of providing a logging tool at the lower end of a drill pipe as an exposed extension to said drill pipe, displacing the tool thus exposed through said portion of the well by connecting additional sections of drill pipe and lowering the drill pipe, and, during this displacing step, continuously generating and sending uphole a signal indicative of the compressive load undergone by the tool.

6 Claims, 3 Drawing Figures

METHOD AND APPARATUS FOR DISPLACING LOGGING TOOLS IN DEVIATED WELLS

The present invention relates to a method and apparatus for displacing a logging tool in a non-gravity descent portion of a well (i.e. a portion which logging tools cannot traverse by the action of gravity), such as a highly deviated portion of a well.

A known method for logging highly deviated wells, disclosed in U.S. Pat. No. 4,457,370, consists of the following steps. A well logging tool is secured to the bottom of a section of drill pipe, inside a protective sleeve, and the tool is lowered into the well as additional sections of pipe are assembled. An electrical connector attached to the end of a wireline cable is then inserted into the drill pipe, the cable is passed through a side entry sub mounted on top of the drill string and the connector is pumped down through the drill pipe into engagement with a mating connector attached to the logging tool to effect connection of the tool to the cable and therefore the surface control equipment. Then other sections of drill pipe are added, the portion of the cable above the side entry sub running outside the drill pipe, until the tool reaches the bottom of the section to be logged. Then the logging operation is performed as the drill pipe is raised.

A drawback of this known technique resides in that the tool is secured inside a protective sleeve during the logging operation. Thus, protective sleeves have to be specifically designed for each type of logging tool, and for certain types of measurements, the presence of such a sleeve may alter the quality of the measurements. Another limitation is related to the diameter of the borehole. Since the overall outer diameter of the measurement device is substantially increased by the protective sleeve, small diameter boreholes cannot be logged.

An alternative technique, disclosed in U.S. Pat. No. 4,485,870, consists of securing to the upper end of the tool a tubular extension (stinger). The connector is pumped from the surface through the drill string and then through the extension stinger. Then the tool is unlatched from the bottom of the drill pipe and the stinger is pumped down to bring the tool to the bottom of the section of interest, and then the tool together with the stinger is moved uphole for carrying out the logging measurements by pulling on the cable. This method does not suffer the above-mentioned limitations, but the equipment it requires is more complex.

The object of the invention is to provide a method for displacing logging tools in a non-gravity descent portion of a well, which does not affect the quality of the measurements and is suitable for small diameter boreholes, and requires simple equipment for its implementation.

According to the invention, the tool is secured to the end of a section of drill pipe as an exposed extension to said section, and is displaced to the level of interest in the well by the addition of sections of drill pipe. During this displacing step, a signal indicative of the compressive load undergone by the tool is continuously generated and sent uphole, whereby the displacement of the tool can be interrupted in the case of an abnormal variation of the compressive load.

The invention will be clearly understood from the following description, made with reference to the attached drawings.

Figure 1:
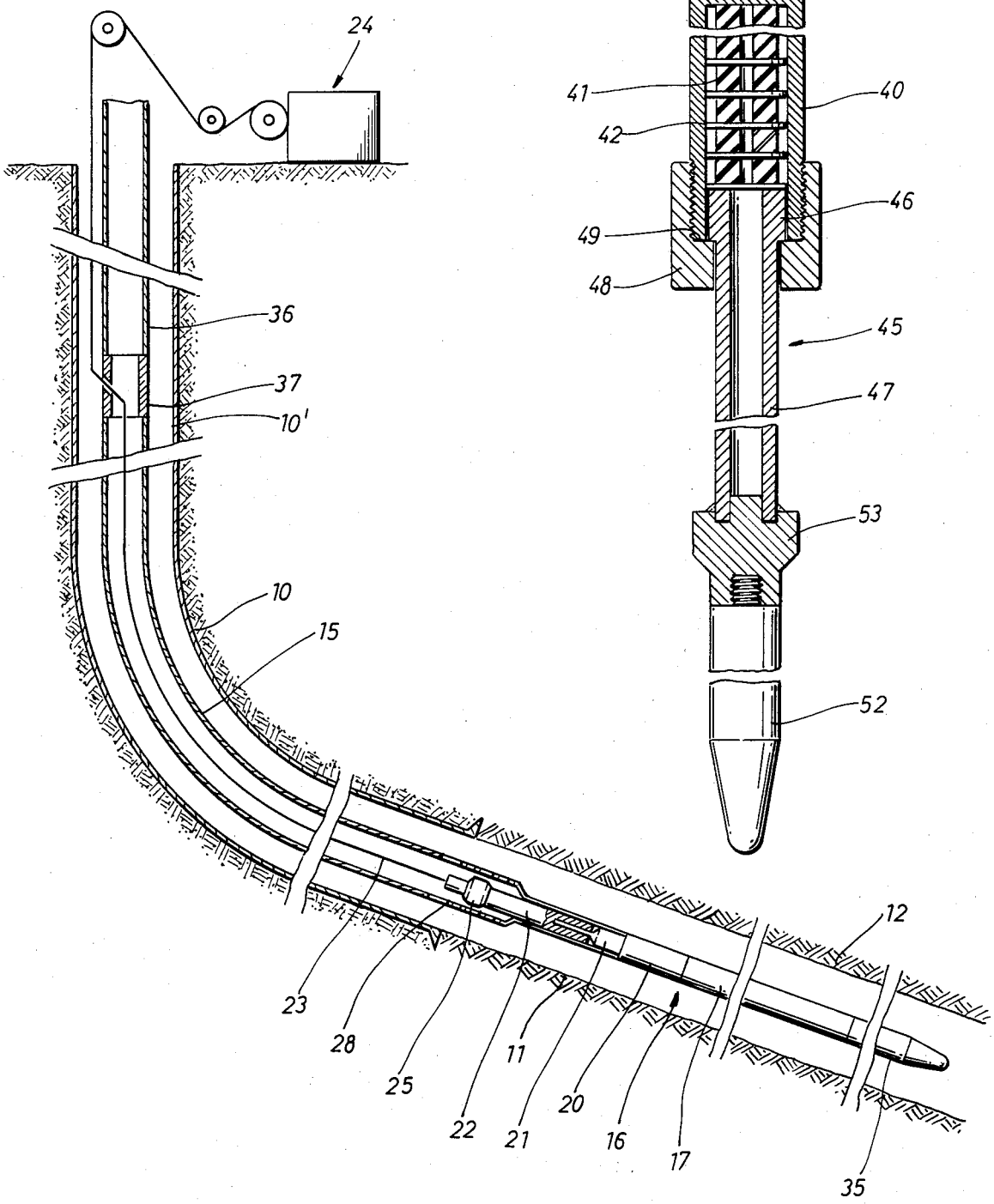
FIG. 1 is a schematic view of the downhole equipment for implementing the method of the invention, in one embodiment.

FIG. 1 shows a well including a cased portion 10 having a substantially vertical upper portion 10', and a highly deviated uncased portion 11 ("open hole") at the bottom. Portion 11 is the portion in which logging measurements are desired in order to determine the properties of the geological formations 12 traversed by the well.

The equipment shown in FIG. 1 for carrying out the logging measurements comprises a drill pipe 15. A logging tool assembly 16 is secured to the bottom end of the drill pipe 15. The tool assembly includes a logging tool 17, which can be any type of tool, for instance induction, neutron, sonic, etc, or any combination of such tools made up by end-to-end connection of individual tools. As is conventional, a telemetry cartridge, not shown, is provided at the upper part of the tool.

The tool assembly also includes a compressive load sensor 20 secured to the upper end of the logging tool 17. The sensor 20 is mechanically connected to the tool 17 so as to measure the compressive effort undergone by the tool. The sensor 20 is preferably of the type described in U.S. Pat. No. 4,265,210, which is incorporated herein by reference. This sensor, which includes a metal rod the elongation of which is detected by means of Thomson transformers, is routinely used to measure the tension in the wireline cable, but can also be used to measure the compressive effort exerted on the tool 17. A detailed description of this sensor can be found in the above-mentioned patent and need not be repeated here. The sensor 20 is secured to an electrical connector portion 21 which, in use, matingly engages a complementary connector portion 22 for effecting the connection of a plurality of electrical contacts. The complementary connector portion 22 forms the lower end of a wireline cable 23 through which control and information signals are conveyed between the tool assembly and a surface equipment 24 including a winch unit for the cable. The connector 21 can be a male connector and the connector 22 a female connector, although the reverse arrangement can also be used. A connector suitable for the purpose of the invention is disclosed in pending U.S. application Ser. No. 565,795 filed Dec. 27, 1983, entitled "Wet Electrical Connector" and assigned to the assignee of the present application. This application is incorporated herein by reference. The rear part of the connector portion 22 mounts a swab member 25 useful as a locomotive for the pumping down step referred to hereinbelow. The connector portion 21 is connected to the lower end of the drill pipe through a tubular circulation sub 28 screwed to the end of the drill pipe, and having a plurality of holes to allow the drilling mud pumped down through the drill pipe to escape into the annulus between the tool assembly and the wall of the borehole.

The tool assembly further includes a shock absorber 35 secured to the bottom of the tool 17. The shock absorber will be described in more detail hereinbelow with reference to FIG. 2.

The cable drill pipe 15 is connected to an upper section of drill pipe 36 through a side entry sub 37 which permits the cable 23 to be passed from inside the drill pipe 15 to the exterior of the drill pipe section 36, as clear from FIG. 1. Side entry subs are disclosed in U.S. Pat. Nos. 4,062,551 to Base, 4,388,969 to Marshal et al, and French patent application No. 2,502,236. A preferred device is disclosed in pending U.S. application Ser. No. 700,207 filed Feb. 11, 1984, entitled "Side-Entry Sub", assigned to the assignee of the present application. This application is incorporated herein by reference.

Figure 2:
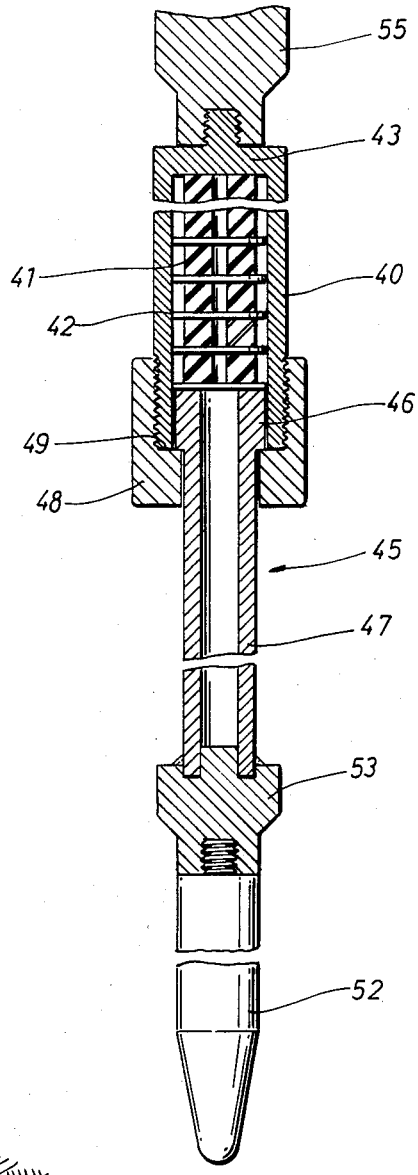
FIG. 2 shows in more detail a part of the embodiment shown in FIG. 1.

FIG. 2 shows in more detail an embodiment of the shock absorber 35. The shock absorber comprises a housing 40 which accommodates a stack of thick rubber washers 41 with thin metal disks 42 positioned between each pair of adjacent rubber washers 41. The housing is closed at one end by a wall 43, and open at the other end, and a piston 45 has at its end a thrust portion 46 slidably mounted in the housing 40 at the open end thereof so as to engage the stack of rubber washers. The thrust portion 46 has an outer diameter larger than the stem 47 of the piston, and a ring 48 is in threaded connection with the end of the housing 40 and has a shoulder 49 engaging the enlarged thrust portion 46 of the piston to act as a retainer for the piston and provide a suitable pre-load of the rubber washers. A nose piece 52 with a tip of rounded shape or other suitable profile forms the forward end of the shock absorber to facilitate the advance of the tool assembly through the well, the nose piece 52 being screwed to an end portion 53 of the piston secured to the stem 47. The drawing also shows at 55 the forward end of the logging tool, to which the end wall 43 of the housing is attached. It is to be noted that, although the drawing shows one shock absorber module, several modules can be assembled in end-to-end connection to increase the total stroke capable of being absorbed by the device.

The equipment shown in FIG. 1 is operated as follows.

The tool assembly 16 is assembled at the surface and secured to the end of a section of drill pipe. The drill pipe 15 is then made up with the tool assembly at its bottom end, by connecting other sections of drill pipe and lowering the drill pipe, until the tool assembly reaches the top of the section of interest of the well, which is the open hole portion. Then the female connector suspended from cable 23 is introduced into the drill pipe 15, and the cable 23 is passed through the side entry sub 37, which is secured to the top of the drill pipe 15. The female connector is then displaced through the drill pipe until it engages the male connector 21 which is part of the tool assembly, by pumping the drilling fluid inside the drill pipe. After the connection is made up, the drill pipe section 36 is formed by connecting new sections of pipe, and by so doing, the tool assembly is displaced further to the bottom of the section of interest. This displacement takes place through the open hole section 11 of the well. During this displacement, the sensor 20, now connected to the surface equipment 24 by the cable 23, generates continuously a signal indicative of the compressive load undergone by the tool assembly. The compressive effort normally varies within a limited range: it increases when the assembly rubs against the wall of the borehole and decreases when such rubbing ceases. If the well is obstructed, the compressive load will show a sharp increase and the operator of the drill pipe will immediately stop the displacement of the drill pipe. During the short period of time it takes for the drill pipe to be stopped after an increase in compressive load has been signalled, the drill pipe will move downward a small distance. The shock absorber 35 will then be compressed, whereby the logging tool will not be crushed as a result of the continuing movement of the drill pipe and damage to the logging tool will be avoided.

If an obstruction is found in the well, as mentioned above, the operator can be able to overcome it by moving the drill pipe upward a short distance and then moving the drill pipe downward at reduced speed.

After the bottom of the section of interest has been reached, the logdging tool is activated by control signals from the surface equipment to effect measurements and is moved upward by pulling upward and removing the drill pipe section 36, while winding up the cable 23 over the winch unit of the surface equipment at the same time.

Figure 3:
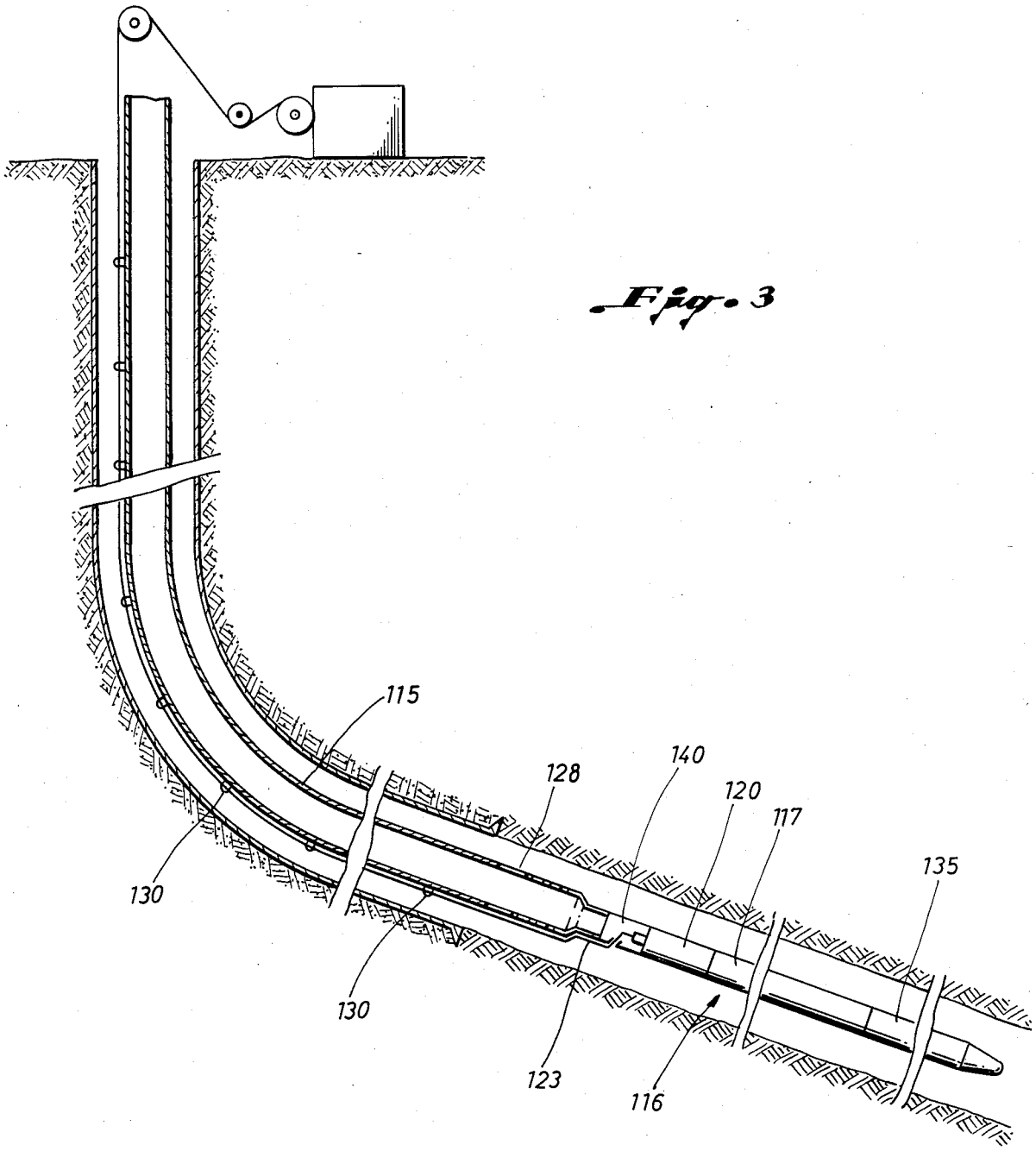
FIG. 3 illustrates an alternative embodiment of the invention.

FIG. 3 illustrates an alternative technique for effecting the connection of the logging tool and the cable. A drill pipe 115 has secured to its bottom end a tool assembly 116 which includes a logging tool 117, a compressive load sensor 120 connected to the upper end of the tool 117, a shock absorber 135 attached to the bottom end of the tool 117. The indications given above concerning the compressive load sensor 20 and the shock absorber 35 apply as well to the sensor 120 and the shock absorber 135, respectively. A cable head sub 140 is secured to the top of the sensor 120. The cable head sub 140 has a lateral passage to direct the cable 123 to the exterior of the tool assembly 116. The cable 123 from this point up to the top of the drill pipe is held on the exterior of the drill pipe 115 by cable clamps 130 provided on each individual section of drill pipe in the vicinity of the joint. The cable head sub 140 is secured to the bottom end of the drill pipe 115 through an adapter sub 128 having a plurality of holes to allow the drilling fluid to escape from the interior of the drill pipe, if for some reason the drilling fluid needs be pumped.

In this case, the operation is as follows. The tool assembly is made up at the surface, and the connection with the cable 123 is effected by connecting the cable head sub 140 to the cable and securing the cable head sub 140 to the top of the tool assembly. Then the sub 140 is attached to a section of drill pipe and the drill pipe 115 is then made up by connecting additional sections of pipe, while corresponding lengths of cable are unwound from the winch unit. At each connection, the cable 123 is secured to the exterior of the drill pipe by means of the respective cable clamp 130. This lowering step is continued until the logging tool reaches the level of interest in the well i.e. the bottom of the section to be logged. The sensor 120 generates a signal indicative of the compressive load on the tool throughout the lowering step, and particularly during the displacement of the tool assembly through the uncased portion of the well. The logging operation itself is then carried out by activating the logging tool while raising the drill pipe and removing sections of drill pipe, and rewinding the cable on the winch unit.

The invention is not useful only in the type of well described above, but is applicable to all the wells having a portion which cannot be traversed by logging tools by the action of gravity either because of its high deviation or because of difficult hole conditions.

I claim:

1. A method for displacing a logging tool through a non-gravity descent portion of a well, comprising the steps of providing a logging tool at the lower end of a drill pipe as an exposed extension to said drill pipe, displacing the tool thus exposed through the non-gravity descent portion of the well by connecting additional sections of drill pipe and lowering the drill pipe, and, during this displacing step, continuously generating and sending uphole a signal indicative of the compressive load undergone by the tool.

2. A method for displacing a logging tool through a non-gravity descent portion of a well, comprising the steps of providing a logging tool at the lower end of a drill pipe as an exposed extension to said drill pipe, said tool being connected by a cable to a surface equipment, displacing the tool thus exposed through the non-gravity descent portion of the well by connecting additional sections of drill pipe and lowering the drill pipe, and, during this displacing step, continuously generating and sending to the surface equipment a signal indicative of the compressive load undergone by the tool.

3. A method for logging a non-gravity descent portion of a well comprising the steps of providing a logging tool at the lower end of a drill pipe as an exposed extension to said drill pipe, said tool being connected by a cable to a surface equipment, displacing the tool thus exposed through the non-gravity descent portion of the well by connecting additional sections of drill pipe and lowering the drill pipe, and, during this displacing step, continuously generating and sending to the surface equipment a signal indicative of the compressive load undergone by the tool, and carrying out a logging operation by operating the logging tool while raising the drill pipe and removing said additional sections of drill pipe.

4. The method of claim 3, wherein shock absorbing means are attached to the logging tool.

5. An apparatus for logging a non-gravity descent portion of a well, comprising a drill pipe, a logging tool secured to the bottom end of the drill pipe as an exposed extension to said drill pipe, a sensor connected to the tool for producing a signal indicative of the compressive load undergone by the tool, and cable means for uphole transmission of said signal.

6. The apparatus of claim 5, comprising shock absorbing means attached to the bottom of the logging tool.

* * * * *

UNITED STATES PATENT AND TRADEMARK OFFICE

CERTIFICATE OF CORRECTION

PATENT NO. : 4,597,440

DATED : July 1, 1986

INVENTOR(S) : Alain P. Pottier

It is certified that error appears in the above-identified patent and that said Letters Patent is hereby corrected as shown below:

Column 2, Line 29 after "No." delete "4,265,210", add --4,265,110--.

Signed and Sealed this

Eighteenth Day of November, 1986

*Attest:*

DONALD J. QUIGG

*Attesting Officer* *Commissioner of Patents and Trademarks*